United States Patent [19]

Glowinski et al.

[11] 4,046,562

[45] Sept. 6, 1977

[54] ELECTROPHOTOGRAPHIC RECORDING MATERIAL AND ITS METHOD OF MANUFACTURE

[75] Inventors: Wolf Glowinski, Warstein; Hartmut Dülken, Belecke; Gottfried Guder, Belecke; Karl-Heinz Kassel, Belecke, all of Germany

[73] Assignee: Licentia Patent-Verwaltungs-G.m.b.H., Frankfurt am Main, Germany

[21] Appl. No.: 534,220

[22] Filed: Dec. 19, 1974

[30] Foreign Application Priority Data

Dec. 21, 1973 Germany ..... 2363738

[51] Int. Cl.[2] ..... G03G 5/04; C25D 5/00

[52] U.S. Cl. ..... 96/1.5 R; 274/38 S; 427/248 R; 427/404

[58] Field of Search ..... 96/1.5; 427/404, 248; 204/105 R, 38 S

[56] References Cited

U.S. PATENT DOCUMENTS

| | | | |
|---|---|---|---|
| 3,243,293 | 3/1966 | Stockdale | 96/1.5 |
| 3,607,388 | 9/1971 | Hori et al. | 96/1.5 |
| 3,615,413 | 10/1971 | Fisher et al. | 96/1.5 |
| 3,684,503 | 8/1972 | Humphriss et al. | 96/1.5 |
| 3,707,372 | 12/1972 | Hallman et al. | 96/1.5 |
| 3,712,810 | 1/1973 | Ciuffini | 96/1.5 |
| 3,775,109 | 11/1973 | Ohta et al. | 96/1.5 |

FOREIGN PATENT DOCUMENTS

| | | | |
|---|---|---|---|
| 1,035,892 | 7/1966 | United Kingdom | 96/1.5 |

*Primary Examiner*—Jack P. Brammer
*Attorney, Agent, or Firm*—Spencer & Kaye

[57] ABSTRACT

An electrophotographic recording material comprises a photoconductive layer of selenium, selenium compounds, or alloys with selenium, a conductive and flexible substrate, and an intermediate layer between the substrate and photoconductive layer, the intermediate layer being a metal having a modulus of elasticity of less than 6000 kp/mm² and a recrystallization temperature of less than 40° C.

14 Claims, 1 Drawing Figure

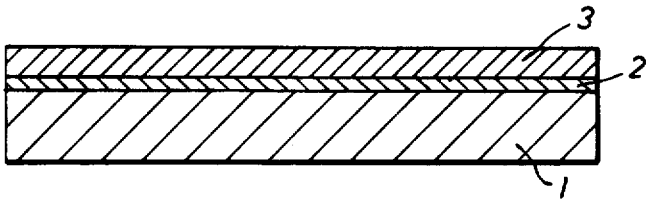
3
2
1

ELECTROPHOTOGRAPHIC RECORDING MATERIAL AND ITS METHOD OF MANUFACTURE

FIELD OF THE INVENTION

The present invention relates to an electrophotographic recording material of selenium, selenium compounds or alloys with selenium applied to a conductive, flexible substrate over an intermediate layer, as well as to a method for producing such recording material.

BACKGROUND OF THE INVENTION

Electrophotographic methods and apparatus to practice such methods have found wide acceptance in the reproduction art. They utilize the property of the photoconductive material to undergo local changes in its electrical resistance upon being exposed to activating radiation.

After being electrically charged and exposed to activating radiation in a pattern determined by an optical image, a photoconductive layer produces a latent electrical charge pattern which corresponds to the optical picture, or image. At the exposed points or areas the conductivity of the photoconductive layer is increased to such an extent that a part or substantially all of the electrical charge can disappear or flow off through the conductive substrate, but in any event the electrical charge disappears or flows off to a greater extent than at the unexposed points or areas where the electrical charge remains substantially unchanged. The electrical charge at the unexposed points or areas which correspond to the stored image can then be made visible with an image powder, a so-called toner, and the resulting toner image, if this should be required, can be transferred to paper or some other carrier.

Organic as well as inorganic substances are used as electrophotographically active substances. Among them, selenium, selenium compounds or alloys with selenium have gained particular importance.

The conductive substrates that have been used can be made of metals, such as, preferably, aluminum, aluminum alloys or steel and brass. Nonconductive carriers which are provided with an electrically conductive coating can also be used as the conductive substrate. For example, a glass carrier covered with an electrically conductive coating of tin dioxide can be used as a conductive substrate.

Electrophotographic recording instruments in which the photoconductive layer is applied to a planar plate as the conductive substrate are not very well suited for rapid, continuous operation. The planar carrier plates are thus often replaced by cylindrical drums as the conductive substrate. These drums, however, have the drawback that, due to their curved surface, the image can be transferred only in strips and the width of these strips is determined by the depth of focus of the reproducing system.

When using drums, it is therefore necessary to move the original that is to be copied or parts of the optical system in synchronism with the rotation of the drum. With high copying speeds, such precision movements are rather difficult as is the transmission of the required quantity of light, because sufficient quantities of light must be able to reach the electrophotographic layer within a very short period of time.

It is possible to increase the operating speed if the photoconductive layer does not have a curved surface but instead has a planar surface because with a planar surface it is possible to simultaneously reproduce wider strips of the original or even the entire original. This is accomplished in conventional electrophotographic recording instruments, for example, by using a flexible coated substrate which is unwound, for example, from a roller and wound onto a second roller or is conducted as an endless belt over two or more rollers. That portion of the belt which is being exposed at the moment is then stretched into a planar plane. For this purpose, belts of aluminum, steel or brass have been used as the conductive substrate because of their good mechanical properties. In addition, plastic belts coated with conductive coatings of aluminum or potassium iodide, such as polyethylene terephthalate polyester films coated with aluminum or potassium iodide, or belts of paper or types of rubber as well as woven or nonwoven, fibrous belts of glass, cotton or silk which have been appropriately made conductive can also be used as the conductive substrate.

The above-mentioned advantages of such flexible carrier belts as the conductive substrate are counteracted by the drawback that it is difficult to obtain sufficient adhesion between the substrates and the photoconductive layer and damage to the photoconductive layer during movement is difficult to prevent. The continuous bending of the photoconductive layer during its travel around the rollers leads to the formation of cracks and breaks, particularly at a high operating speed, because the photoconductive materials are generally relatively hard, brittle and glassy, and even if they have only a very thin layer thickness, the photoconductive layer will finally peel off from the flexible conductive substrates.

It has been believed that these drawbacks of the flexible conductive substrates could be overcome by improving the adhesion between the conductive substrate and photoconductive material. For this purpose, it has been proposed, for example, to roughen the aluminum coating by ion bombardment before the photoconductive material is applied or to apply an intermediate layer with good adhesion with respect to the substrate as well as to the photoconductive material between the flexible substrate belt and the photoconductive layer, which intermediate layer has as little influence as possible on the electrophotographic sensitivity of the system.

Known intermediate layers substantially comprise polymerized organic or silicon organic plastics, such as, for example, nonconductive resin binders with or without additives of phthalocyanine pigments or of substituted sylil isobutyl ethylene diamine. Graphite has also been used as the intermediate layer. The drawback in such intermediate layers is, on the one hand, that there is a noticeable reduction of the electrophotographic sensitivity. On the other hand, the plastic intermediate layers sometimes have layer thicknesses of only $0.1\mu$, and this causes added technical difficulties in the production of the recording material, particularly if at the same the layer thickness is supposed to be uniform. Finally, it has been found that, while the use of such intermediate layers might initially improve the adhesion, over a period of time fatigue develops and, as a result of the continuous bending, microcracks are formed which substantially limit the usefulness of the electrophotographic recording material or even make it impossible.

SUMMARY OF THE INVENTION

It is an object of the present invention to overcome the above disadvantages and provide an improved electrophotographic recording material. A further object of the invention is to improve, in an electrophotograhic recording material of selenium, selenium compounds or alloys with selenium, and applied to a conductive, flexible substrate over an intermediate layer, the adhesion between substrate and photoconductive material. A still further object of the invention is to improve in such an electrophotographic recording material, the adhesion between substrate and photoconductive material and at the same time to increase the bending resistance to such an extent that microcracks will no longer occur in the photoconductive layer from bending of the flexible substrate when it is guided over rollers so that the electrophotographic recording material remains usable.

Additional objects and advantages of the invention will be set forth in part in the description which follows, and in part will be obvious from the description, or may be learned by practice of the invention. The objects and advantages are realized and attained by means of the steps and combination particularly pointed out in the appended claims.

To achieve the foregoing objects and in accordance with its purpose, this invention provides an electrophotographic recording material which comprises a photoconductive layer of selenium, selenium compounds or alloys with selenium, a conductive, flexible substrate, and an intermediate layer between the substrate and photoconductive layer, with the intermediate layer comprising a metal having a modulus of elasticity below 6000 kp/mm$^2$ and a recrystallization temperature below 40° C.

In a preferred embodiment of the invention, the intermediate layer is a metal having a modulus of elasticity of less than 2000 kp/mm$^2$ and a recrystallization temperature below 40° C.

DESCRIPTION OF THE DRAWING

The sole FIGURE of the drawing is a schematic representation of an electrophotographic recording material made in accordance with the teachings of the present invention.

DETAILED DESCRIPTION OF THE INVENTION

In the practice of the present invention an intermediate layer made of a metal having a modulus of elasticity below 6000 kp/mm$^2$ and a recrystallization temperature of below 40° C is applied to a flexible conductive substrate. The flexible conductive substrate can be one of those previously used for this purpose and preferably is in the form of a steel or nickel belt. A flexible steel or nickel belt carrier having a layer thickness of about 0.05 to 0.2 mm, and preferably a layer thickness of about 0.1 mm has been found to be especially satisfactory.

The metal that is applied to the flexible conductive substrate and which has the required modulus of elasticity and recrystallization temperature preferably is lead or indium. Lead has a modulus of elasticity of 1620 kp/mm and a recrystallization temperature of less than 20° C. Indium has a modulus of elasticity of 1090 kp/mm$^2$ and a recrystallization temperature of less than 20° C.

Other suitable metals include tin, thallium, gallium, and the alkalimetals. Metal alloys having the required modulus of elasticity and recrystallization temperature can also be used, e.g. indium-gallium alloys, Wood's metal, Rose's metal, and solder alloys. Generally, suitable metals should have a modulus of elasticity as low as possible and a melting point greater than room-temperature. The intermediate metal layer can be applied to the flexible conductive substrate in accordance with known techniques such as for example by vapor deposition of the metal layer onto the substrate or by electro-plating or by depositing the metal on the substrate from a molten bath.

After the intermediate layer of metal having the required modulus of elasticity and recrystallization temperature is applied to the flexible conductive substrate, a photoconductive selenium containing layer is applied to the intermediate layer. For example the selenium layer can be in the form of pure selenium, or compounds or alloys of selenium with arsenic such as Se + 1 atomic percent As, $AS_2Se_5$, or selenium-tellurium mixtures. The photoconductive layer can be applied in a layer thickness of from about 20 to 80$\mu$. Surprisingly, the present invention makes it possible to use photoconductive layers having thicknesses greater than 35$\mu$ and up to 80$\mu$ on the flexible substrates while when using conventional intermediate layers the layer thicknesses of the photoconductive layer could be no more than 20 to 35$\mu$. The expansion of the useful layer thickness range is a further advantage of the present invention.

Depending on the particular metal used, the intermediate layer can have a layer thickness ranging from about 0.5 to about 12$\mu$. When using lead as the intermediate layer, the lead can have a layer thickness of about 3 to 12$\mu$, preferably 6$\mu$. When using indium as the intermediate layer, the indium can have a layer thickness of 0.5 to 4$\mu$, preferably 2$\mu$.

The electrophotographic recording material of the present invention enables the photoconductive layer to be bent up to an angle of 180° and over a radius down to 25 mm or less without formation of microcracks in the photoconductive layer and without separation from the substrate because the elastically and plastically well deformable intermediate metal layer has a stress reducing property with respect to the photoconductive layer in certain layer thickness regions of the intermediate layer. Thus, by using an electrophotographic recording material of the present invention, it is possible to guide the flexible substrate belt over rollers having a relatively small radius, which reduces the space requirements for instruments provided with such belts in a desirable manner.

A further advantage of the present invention is that the layer thickness of the photoconductive layer need not be dimensioned merely according to its mechanical properties, i.e. it need not be kept particularly thin, which under certain circumstances could have an adverse effect on the properties of the recording material and would restrict its range of application. Rather, the use of an intermediate layer according to the present invention enables the layer thickness of the photoconductor to be selected substantially according to the requirements at hand for the electrophotographic properties. Thus photoconductors with layer thicknesses up to 80$\mu$ can be used without a danger of damage. The particularly low recrystallization temperature of the intermediate metal layer used in the present invention enables it to maintain its plastic-elastic behavior even after continued bending, due to its extended plastic region, and it will not harden or become brittle. The intermediate metal layer also permanently reduces the stress in the photoconductive layer.

Contrary to the opinion prevalent in the art that an improvement in adhesion alone with a possibly additional simultaneous reduction in the layer thickness of the photoconductive layer will prevent tearing and separation of the photoconductive layer, it has been found in accordance with the present invention that the bending resistance can be sufficiently increased and the occurrence of microcracks can be eliminated by the practice of the present invention by use of an intermediate metal layer having the specified modulus of elasticity and recrystallization temperature. The present invention leads to increased thicknesses of the photoconductive layer instead of reduced thicknesses.

The interaction of the special properties of the intermediate layer with respect to its modulus of elasticity as well as its recrystallization capability within a quite defined layer thickness region is believed to have a synergistic effect and causes the stresses occurring in the photoconductive layer during bending to be reduced. The reduction in stresses simultaneously eliminates the danger of the formation of microcracks while with the prior art methods, which were directed only toward increasing adhesion, the result was undesirable stress concentration.

In one preferred embodiment of the present invention, an inhibiting layer is applied between the metallic intermediate layer and the photoconductive layer in order to inhibit the injection of charge carriers from the metallic layer into the photoconductive layer. This can be accomplished, for example, by providing an aluminum oxide layer with a layer thickness of 0.1 $\mu$ or possibly less, or by providing a thin insulating plastic intermediate layer between the photoconductive layer and metallic intermediate layer.

The production of the inhibiting layer according to the invention is effected in a known manner, for example, by vapor deposition or by spraying. In case of a positive surface charge on the photoconductive layer, the intermediate layer may advantageously consist of polyvinyl carbazole. The layer is made by spraying a solution of polyvinyl carbazole (5 g) in monochlorbenzene (100 $cm^3$) so as to give a layer of 1 $\mu$ after evaporation of solvent.

In this case, the mobility of the electrons in the intermediate layer is small with respect to the mobility of the holes or, in case of a negative charge on the surface of the photoconductive layer an insulator for one charge carrier type and is electrically conductive for the other charge carrier type. In case of a negative charge on the photoconductive layer, the intermediate layer may consist of trinitrofluorenone. The recrystallization temperature is the lowest temperature which is necessary to produce recrystallization. The recrystallization refers to removal of lattice defects by formation of new crystals. The lattice defects arise from the mechanical deformation of the intermediate layer by bending the belt during movement. Generally, the recrystallization temperature is about 0.4 times the melting point temperature in °K.

The following example is intended to illustrate but not to limit the principles of the present invention.

EXAMPLE

In this example lead is provided as the material for the intermediate layer. The lead is applied to a flexible substrate by a vapor-deposition process.

The lead e.g. has a degree of purity of about 99.999% and is vaporized from a chrome-nickel vaporization vessel at a vaporization temperature of about 600 to 800° C at a pressure of about $5.10^{-6}$ Torr. The lead vapor is then deposited on a steel belt having a width of 20 mm and a thickness of 0.1 mm at a substrate temperature of 40° to 60° C until a layer of lead with a thickness of 6$\mu$ is formed on the steel belt. Thereafter a photoconductive selenium layer is vapor-deposited to a thickness of about 55$\mu$ at a substrate temperature of about 60° C and a pressure of about $5.10^{-6}$ Torr.

In this way, a layer sequence results which is shown in the drawing in a schematic representation and which includes a substrate 1 on which a photoconductive layer 3 is disposed over an intermediate layer 2. Experiments have shown that in a recording material produced in the above-described manner no microcracks occur and there is no separation phenomena when the recording material is statically bent over a bending radius of only 11.0 mm and a bending angle of 180°.

It will be understood that the above description of the present invention is susceptible to various modifications, changes and adaptations, and the same are intended to be comprehended within the meaning and range of equivalents and the appended claims.

We claim:

1. Electrophotographic recording material comprising a photoconductive layer of selenium, selenium compounds or alloys with selenium, a conductive, flexible substrate, and an intermediate layer between said substrate and said photoconductive layer, said intermediate layer consisting of a metal having a modulus of elasticity of less than 6000 kp/$mm^2$ and a recrystallization temperature of less than 40° C.

2. Electrophotographic recording material as defined in claim 1 wherein the intermediate layer is a metal having a modulus of elasticity of less than 2000 kp/$mm^2$ and a recrystallization temperature of less than 40° C.

3. Electrophotographic recording material as defined in claim 1 wherein the intermediate layer is made of lead and has layer thickness of about 3 to 12$\mu$.

4. Electrophotographic recording material as defined in claim 1 wherein the intermediate layer is made of lead and has a layer thickness of about 6$\mu$.

5. Electrophotographic recording material as defined in claim 1 wherein the intermediate layer is made of indium and has a layer thickness of about 0.5 to 4$\mu$.

6. Electrophotographic recording material as defined in claim 1, wherein the intermediate layer is made of indium and has a layer thickness of about 2$\mu$.

7. Electrophotographic recording material as defined in claim 1 wherein the flexible substrate is a steel belt having a thickness of about 0.05 to 0.2 mm.

8. Electrophotographic recording material as defined in claim 1 wherein the flexible substrate is a steel belt having a thickness of about 0.1 mm.

9. Electrophotographic recording material as defined in claim 1 wherein the photoconductive layer has a thickness of about 20 to 80$\mu$.

10. Electrophotographic recording material as defined in claim 1 wherein the photoconductive layer has a thickness of about 45 to 80$\mu$.

11. Electrophotographic recording material as defined in claim 1 wherein an inhibiting layer which inhibits the injection of charge carriers is disposed between the metallic intermediate layer and the photoconductive layer.

12. Method for producing an electrophotographic recording material comprising depositing a metal layer having a modulus of elasticity of less than 6000 kp/mm² and a recrystallization temperature of less than 40° C onto a conductive flexible substrate, and then covering said metal layer with a photoconductive material of selenium, a selenium compound or an alloy of selenium.

13. Method as defined in claim 11 wherein the metal layer is vapor deposited on the substrate.

14. Method as defined in claim 11 wherein the metal layer is galvanically deposited on the substrate.

* * * * *